US007487623B2

(12) United States Patent
Rodolofo et al.

(10) Patent No.: US 7,487,623 B2
(45) Date of Patent: Feb. 10, 2009

(54) TRIM ACCESSORY HAVING VENTILATION APERTURES HIDDEN FROM VIEW WHEN MOUNTED ON BUILDING

(75) Inventors: Saul Le-Garcia Rodolofo, Marshall, MI (US); Thomas Charles Gilbert, Clarklake, MI (US)

(73) Assignee: CertainTeed Corporation, Valley Forge, PA (US)

( * ) Notice: Subject to any disclaimer, the term of this patent is extended or adjusted under 35 U.S.C. 154(b) by 573 days.

(21) Appl. No.: 10/758,154

(22) Filed: Jan. 14, 2004

(65) Prior Publication Data

US 2005/0166529 A1 Aug. 4, 2005

(51) Int. Cl.
*E04F 19/06* (2006.01)

(52) U.S. Cl. ..... 52/716.1; 52/288.1

(58) Field of Classification Search ..... 52/94, 52/95, 287.1, 288.1, 198, 716.1, 718.04, 52/717.05, 717.06
See application file for complete search history.

(56) References Cited

U.S. PATENT DOCUMENTS

| | | | | | |
|---|---|---|---|---|---|
| D60,733 | S | * | 3/1922 | Murnane | D25/121 |
| 1,676,582 | A | * | 7/1928 | Stuart | 52/27 |
| 2,546,894 | A | * | 3/1951 | Hodo | 52/630 |
| 2,809,728 | A | * | 10/1957 | Olson | 52/204.597 |
| 3,047,112 | A | * | 7/1962 | Tvorik et al. | 52/288.1 |
| 3,144,881 | A | * | 8/1964 | Sproull | 138/117 |
| 3,159,943 | A | | 12/1964 | Sugar et al. | |
| 3,246,436 | A | | 4/1966 | Roush | |
| 3,289,380 | A | | 12/1966 | Charniga, Jr. | |
| D238,896 | S | * | 2/1976 | Landis | D25/119 |
| 4,102,106 | A | | 7/1978 | Golder et al. | |
| 4,102,587 | A | * | 7/1978 | Herb et al. | 403/205 |
| 4,122,643 | A | * | 10/1978 | Hafner | 52/520 |
| 4,188,762 | A | | 2/1980 | Tellman | |
| 4,189,885 | A | * | 2/1980 | Fritz | 52/287.1 |
| 4,347,691 | A | * | 9/1982 | Lloyd-Jones | 52/95 |
| D273,047 | S | * | 3/1984 | Lloyd-Jones | D25/119 |
| 4,665,675 | A | | 5/1987 | Kelly | |
| 4,930,287 | A | | 6/1990 | Volk et al. | |
| D316,299 | S | * | 4/1991 | Hurlburt | D25/119 |
| 5,016,415 | A | | 5/1991 | Kellis | |
| 5,022,207 | A | | 6/1991 | Hartnett | |
| 5,167,104 | A | | 12/1992 | Alvarado | |
| 5,195,283 | A | | 3/1993 | MacLeod et al. | |
| 5,243,793 | A | | 9/1993 | MacLeod et al. | |
| 5,274,978 | A | * | 1/1994 | Perkonigg et al. | 52/547 |

(Continued)

OTHER PUBLICATIONS

Alside "Charter Oak" soffit sample and description, web page http://www.alside.com/siding/chartsof.htm, date cited Jul. 16, 2002.

(Continued)

*Primary Examiner*—Richard E. Chilcot, Jr.
*Assistant Examiner*—Gay Ann Spahn
(74) *Attorney, Agent, or Firm*—Duane Morris, LLP; Steven E. Koffs

(57) ABSTRACT

A trim accessory includes a soffit receiver component, a siding accessory receiver component and vent apertures. The siding accessory receiver component is integral with the soffit receiver component. The vent apertures are capable of being substantially hidden from view at least when the trim accessory is installed on a building and a soffit and siding accessory are received into the corresponding soffit receiver component and siding accessory receiver component.

19 Claims, 7 Drawing Sheets

U.S. PATENT DOCUMENTS

| | | | | | |
|---|---|---|---|---|---|
| 5,292,281 | A | | 3/1994 | Butler | |
| 5,303,525 | A | | 4/1994 | Magee | |
| D361,138 | S | * | 8/1995 | Moore et al. | D25/119 |
| 5,517,794 | A | * | 5/1996 | Wagner | 52/276 |
| 5,531,050 | A | * | 7/1996 | Stibolt et al. | 52/254 |
| 5,551,201 | A | * | 9/1996 | Anderson | 52/717.05 |
| 5,560,158 | A | * | 10/1996 | Norton | 52/95 |
| 5,560,170 | A | * | 10/1996 | Ganser et al. | 52/539 |
| 5,564,233 | A | * | 10/1996 | Norton | 52/60 |
| 5,657,585 | A | | 8/1997 | Zaccagni | |
| 5,664,376 | A | * | 9/1997 | Wilson et al. | 52/287.1 |
| 5,711,117 | A | | 1/1998 | Zaccagni et al. | |
| 5,718,086 | A | | 2/1998 | Dunn | |
| 5,791,985 | A | | 8/1998 | Schiedegger et al. | |
| 5,799,446 | A | | 9/1998 | Tamlyn | |
| 5,809,731 | A | | 9/1998 | Reiss | |
| 5,829,206 | A | * | 11/1998 | Bachman | 52/94 |
| 5,836,113 | A | * | 11/1998 | Bachman | 52/94 |
| 5,850,717 | A | * | 12/1998 | Schiedegger et al. | 52/288.1 |
| 5,881,502 | A | | 3/1999 | Tamlyn | |
| 5,927,041 | A | * | 7/1999 | Sedlmeier et al. | 52/730.1 |
| 5,937,592 | A | | 8/1999 | Tamlyn | |
| 5,946,876 | A | | 9/1999 | Grace, Sr. et al. | |
| 5,947,816 | A | | 9/1999 | Schiedegger et al. | |
| 5,950,385 | A | * | 9/1999 | Herren | 52/481.1 |
| 5,956,914 | A | | 9/1999 | Williamson | |
| 5,974,748 | A | * | 11/1999 | Sciuga et al. | 52/287.1 |
| 6,003,357 | A | * | 12/1999 | Brown | 72/321 |
| D432,671 | S | * | 10/2000 | Grosfillex | D25/119 |
| 6,134,855 | A | | 10/2000 | Beck | |
| 6,223,488 | B1 | | 5/2001 | Pelfrey et al. | |
| D447,820 | S | * | 9/2001 | Grace | D25/119 |
| 6,341,458 | B1 | * | 1/2002 | Burt | 52/287.1 |
| D454,962 | S | * | 3/2002 | Grace | D25/119 |
| 6,360,508 | B1 | * | 3/2002 | Pelfrey et al. | 52/520 |
| 6,421,964 | B1 | * | 7/2002 | Schiedegger et al. | 52/94 |
| 6,539,675 | B1 | * | 4/2003 | Gile | 52/96 |
| 6,553,732 | B2 | * | 4/2003 | Shaw | 52/287.1 |
| 6,631,595 | B1 | * | 10/2003 | Minter | 52/212 |
| D481,804 | S | * | 11/2003 | Pelfrey | D25/119 |
| 6,679,010 | B2 | * | 1/2004 | Honda | 52/95 |
| 6,708,457 | B1 | * | 3/2004 | Ballough | 52/202 |
| 6,854,397 | B2 | * | 2/2005 | Terajima et al. | 104/95 |
| 6,945,517 | B2 | * | 9/2005 | Augur | 256/1 |
| 6,988,345 | B1 | * | 1/2006 | Pelfrey et al. | 52/519 |
| 7,036,282 | B1 | * | 5/2006 | Keddell | 52/287.1 |
| 7,137,224 | B2 | * | 11/2006 | Rasmussen et al. | 52/96 |
| 7,200,970 | B2 | * | 4/2007 | Koenig et al. | 52/287.1 |
| 2002/0088189 | A1 | * | 7/2002 | Honda | 52/287.1 |
| 2002/0124484 | A1 | * | 9/2002 | Martin | 52/94 |
| 2002/0124485 | A1 | * | 9/2002 | Pulte | 52/96 |
| 2003/0131552 | A1 | * | 7/2003 | Leichtfried | 52/543 |
| 2004/0216397 | A1 | * | 11/2004 | Sigmund | 52/95 |
| 2005/0193671 | A1 | * | 9/2005 | Brochu et al. | 52/506.01 |
| 2005/0223657 | A1 | * | 10/2005 | Brochu et al. | 52/94 |
| 2006/0213142 | A1 | * | 9/2006 | Albracht | 52/543 |

OTHER PUBLICATIONS

Crane Plastics "Premium Point" soffit sample and description, web page http://www.vinyl-siding.com/Soffits.html, date cited Jul. 16, 2002.

Heartland "Woodhaven" soffit sample and description, web page http://www.heart-land.com/cr/HO/Soffitinfo.html, date cited Jul. 16, 2002.

Louisiana Pacific "I-Span" soffit sample and description, © 2000 Louisiana-Pacific Corporation.

* cited by examiner

TRIM ACCESSORY HAVING VENTILATION APERTURES HIDDEN FROM VIEW WHEN MOUNTED ON BUILDING

FIELD OF THE INVENTION

The invention relates generally to an apparatus for use in building construction, and in particular, to a trim accessory for siding and soffits.

BACKGROUND OF THE INVENTION

It is common practice to cover the exterior surfaces of buildings with aluminum or vinyl panels to protect the building and to provide a durable, aesthetically pleasing finish. Conventional building panels are generally comprised of long strips which are attached to one another to cover the exterior surface of the building.

Typical building panels include soffits and siding. Siding, which is generally placed on the side walls of buildings, is installed from the bottom of the building to the top of the building. When the siding reaches a soffit at the top of a wall, it typically requires a cutting or altering of the siding panel in order to fit the existing structure. A finishing system, such as a J-channel or undersill trim is typically employed to maintain a polished and straight appearance of the siding.

Soffits are generally used to cover the underside of roofs or eaves. Soffit panels are typically installed underneath of the roof and disposed so as to face a human observer standing underneath the roof. As with siding panels, an edge of the soffit panel is often inserted into trim accessory, such as a J-channel or an F-channel, to finish the soffit installation. The requirement for different trim accessories for the siding and soffit panels means that building contractors or distributors need to maintain an expensive inventory of multiple types of trim accessories for completing soffit installation.

Additionally, soffit panels generally include venting apertures which permit air to circulate into the attic space to prevent moisture damage to the roof structure. Typically, these venting apertures are comprised of holes disposed in the soffit panel. In most conventional soffit panels, these venting apertures are viewable by the casual human observer standing underneath the roof. Many people find these venting apertures to be aesthetically displeasing as they cause the soffit siding to appear discontinuous. Some people request that builders use non-vented soffit siding due to the appearance of vented siding, even though there may be physical drawbacks to non-vented soffits. For example, without proper ventilation, moisture may get trapped in the attic space. This trapped moisture can create structural damage such as rotting of the building components, and, in cold weather, can cause unwanted moisture build-up on the underside of the roof structure, which leads to the formation of ice dams.

U.S. Pat. No. 5,657,585 to Zaccagni discloses a combination siding panel-trimming and soffit-panel mounting member which is extruded in one piece from a polymeric material, and includes a back panel, an upper front flange for overlying a back edge portion of a soffit panel, a lower front flange for underlying the back edge portion of the soffit panel, and a back flange for engaging an upper edge portion of the siding panel. This trim accessory does not include any apertures for the venting of the soffit panels.

U.S. Pat. No. 5,243,793 to MacLeod et al. discloses a combined soffit vent and bracket apparatus formed from a one-piece plastic extrusion which receives and secures a soffit and siding panel. The apparatus includes a vent panel having vent openings. These openings are clearly visible to an observer when the apparatus is installed onto a building.

Thus, there is presently a need for a trim accessory which integrates a soffit and siding securing element while providing hidden roof ventilation.

SUMMARY OF THE INVENTION

According to one exemplary embodiment, a trim accessory includes a soffit receiver component, a siding accessory receiver component and vent apertures. The siding accessory receiver component is integral with the soffit receiver component. The vent apertures are capable of being substantially hidden from view at least when the trim accessory is installed on a building and a soffit and siding panel are received into the corresponding soffit receiver component and siding accessory receiver component.

Unlike current combined soffit and siding panel receiving trim accessories, the trim accessories described herein include vent apertures which are hidden from the view of an observer standing beneath the trim accessory.

According to another aspect of the invention, a trim accessory includes a soffit receiver component and a siding accessory receiver component. The soffit receiver component has an attachment edge portion, a bottom portion and a connecting portion, the attachment edge portion, bottom portion and connecting portion defining a soffit receiving channel. The siding accessory receiver component is integral with said soffit receiver component and includes a back edge portion, a front portion and a connecting portion, the back edge portion, front portion and connecting portion defining a siding accessory receiving channel. At least one of the bottom portion or connecting portion of the soffit receiver component, or the front portion or connecting portion of the siding accessory receiver component includes vent apertures.

According to another aspect, a trim system for an exterior surface of a building includes a trim accessory, a soffit panel and a siding panel. The trim accessory includes a soffit receiver component defining a soffit receiving channel, a siding accessory receiver component defining a siding accessory receiving channel, and vent apertures which are capable of being substantially hidden from view at least when the trim accessory is installed on a building. The siding accessory receiver component is integral with the soffit receiver component. The soffit panel is received into the soffit receiving channel of the soffit receiver component, and the siding accessory is received into the siding accessory receiving channel of the siding accessory receiver component.

According to a further aspect, a method of installing a trim system on an exterior surface of a building includes providing a trim accessory having a soffit receiver component, a siding accessory receiver component integral with said soffit receiver component, and vent apertures, and installing the trim accessory on the exterior surface of the building such that the vent apertures are hidden from the view of an observer located beneath the trim accessory.

According to another aspect, a trim accessory includes a soffit receiver component, a siding panel receiver component and vent apertures. The siding panel receiver component is integral with the soffit receiver component. The vent apertures are capable of being substantially hidden from view at least when the trim accessory is installed on a building and a soffit and siding panel are received into the corresponding soffit receiver component and siding panel receiver component.

DETAILED DESCRIPTION OF THE INVENTION

Figure 1:
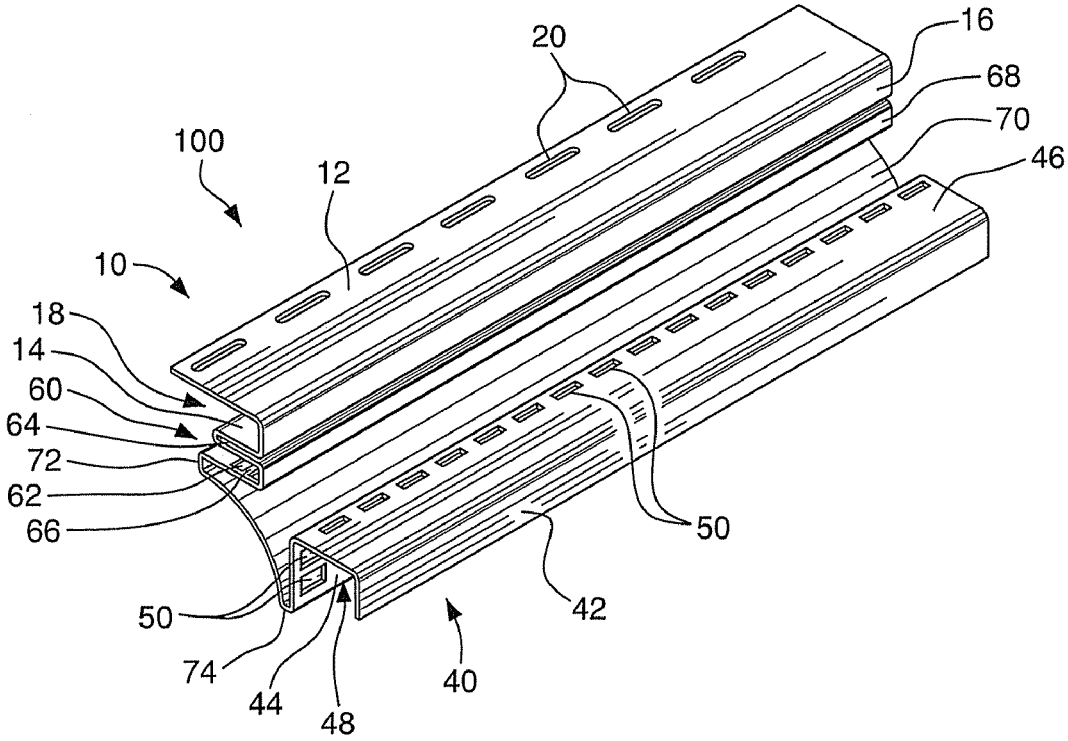
FIG. 1 is an isometric view of an exemplary trim accessory.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Figure 2:
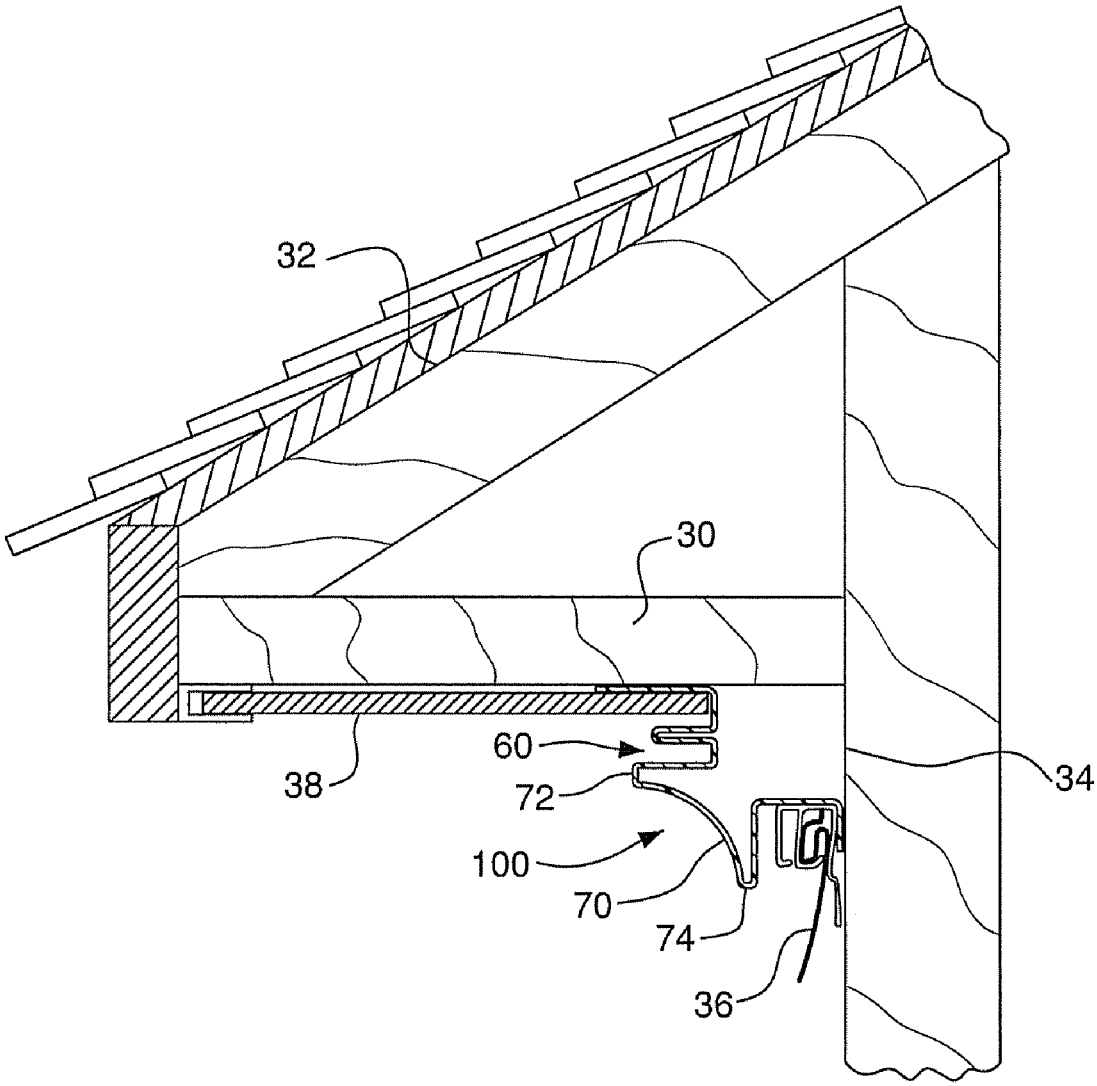
FIG. 2 is a side cross-sectional view of the trim accessory of FIG. 1 shown installed on the exterior of a building.

Referring to FIGS. 1 and 2, one exemplary embodiment of a trim accessory 100 is shown which is a combined soffit and siding panel receiving trim accessory. The trim accessory 100 includes a soffit receiver component 10, a siding accessory receiver component 40 and a plurality of vent apertures 50, 62. The trim accessory 100 is an integral accessory, i.e., it is a one-piece accessory, which may be formed of various materials such as metal, plastic and composite materials. Preferably the trim accessory is comprised of a polymer or a combination of polymers, which may be thermoplastic or thermosetting. Preferably the polymer is polyvinyl chloride (PVC), but may also be polyethylene, polypropylene, polystyrene, polyacrylic materials, or polyester materials, for example.

Depending on the composition of the trim accessory, the trim accessory 100 may be, for example, molded, drawn, vacuum-formed, extruded (e.g., post-formed extruded or profile extruded), roll-formed, or a combination thereof. Where the trim accessory is comprised of PVC, preferably the trim accessory 100 is post-formed extruded.

The soffit receiver component 10 includes an attachment edge portion 12, a bottom portion 14, and a connecting portion 16. The attachment edge portion 12, bottom portion 14 and connecting portion form a soffit receiving channel 18. Preferably the soffit receiver component 10 is substantially J-shaped and includes a plurality of attachment slots 20 on the attachment edge portion 12. The attachment edge portion 12 is secured to soffit furring board 30, for example, underneath the eave of a roof 32 by nails or screws inserted through attachment slots 20.

The siding accessory receiver component 40 includes a back edge portion 42, a front portion 44 and a connecting portion 46. The back edge portion 42, front portion 44 and connecting portion 46 form a siding accessory receiving channel 48. Preferably, the siding accessory receiver component 40 is substantially J-shaped. Upon installation, the back edge portion 42 of the siding accessory receiver component 40 is against the outside wall 34 of the building structure. Such back edge portion 42 may include attachment slots (not shown) for securing the back edge portion 42 against the outside wall 34. The siding accessory receiver component 40 may also include vent apertures 50 for facilitating air circulation and air movement. The vent apertures 50 are preferably located on one or both of the front portion 44 and connecting portion 46 as shown in FIG. 1. At these locations, the vent apertures 50 will be hidden from view upon installation of the trim accessory 100 and corresponding siding accessory 37, siding panel 36 and soffit panel 38.

As shown in the embodiment in FIGS. 1 and 2, the trim accessory 100 may also include a vent component 60 which is employed to accommodate vent apertures 62. As shown in FIG. 1, the vent component 60 may include first and second parallel edges 64, 66 and a connecting edge 68. In the exemplary embodiment of FIG. 1, the first parallel edge 64 is connected to the bottom portion 14 of the soffit receiver component 10 and the second parallel edge 66 is connected to the cove molding 70, or other aesthetic component, as described below.

The vent apertures 62 may be located on edge 64, as shown, or along the connecting edge 68, or any other location on the vent component 60 which facilitates air circulation behind the soffit panels. It should be understood that the vent component 60 can have any configuration that allows the vent apertures to be hidden, or substantially hidden, from view upon installation of the trim accessory 100 and the corresponding soffit and siding panels. The use of a trim accessory having vent apertures, whether on a vent component like vent component 60 or elsewhere on the trim accessory, advantageously reduces or eliminates the need for vented soffit panels which may be aesthetically unpleasing.

Trim accessory 100 may also include an aesthetic component, such as the cove molding 70 shown in FIG. 1. The aesthetic component may add a finished or aesthetically pleasing look to completed soffit and siding panel installation, and also may serve as an element for integrating the soffit receiver component and the siding accessory receiver component. The aesthetic component may comprise a variety of shapes or forms, including the arc-shape of cove molding 70, or alternatively a crown-molding shape or any other aesthetically pleasing shape. The exemplary aesthetic component 70 of the trim accessory 100 includes a first end 72 connected to the second parallel edge 66 of the vent component 60 and a second end 74 connected to the front portion 44 of the siding accessory receiver component 40. In an alternative embodiment of the trim accessory, the trim accessory is lacking a vent component 60, and an aesthetic component, such as the cove molding 70 of FIGS. 1 and 2, is directly connected to the soffit receiver component and the siding accessory receiver component.

Figure 3:
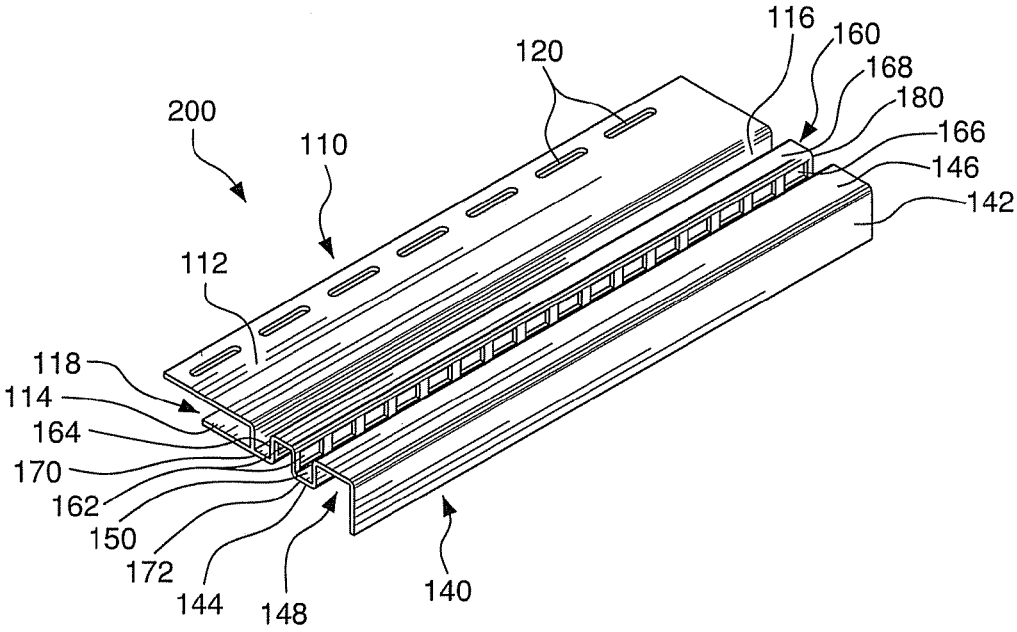
FIG. 3 is an isometric view of another exemplary trim accessory.
Figure 4:
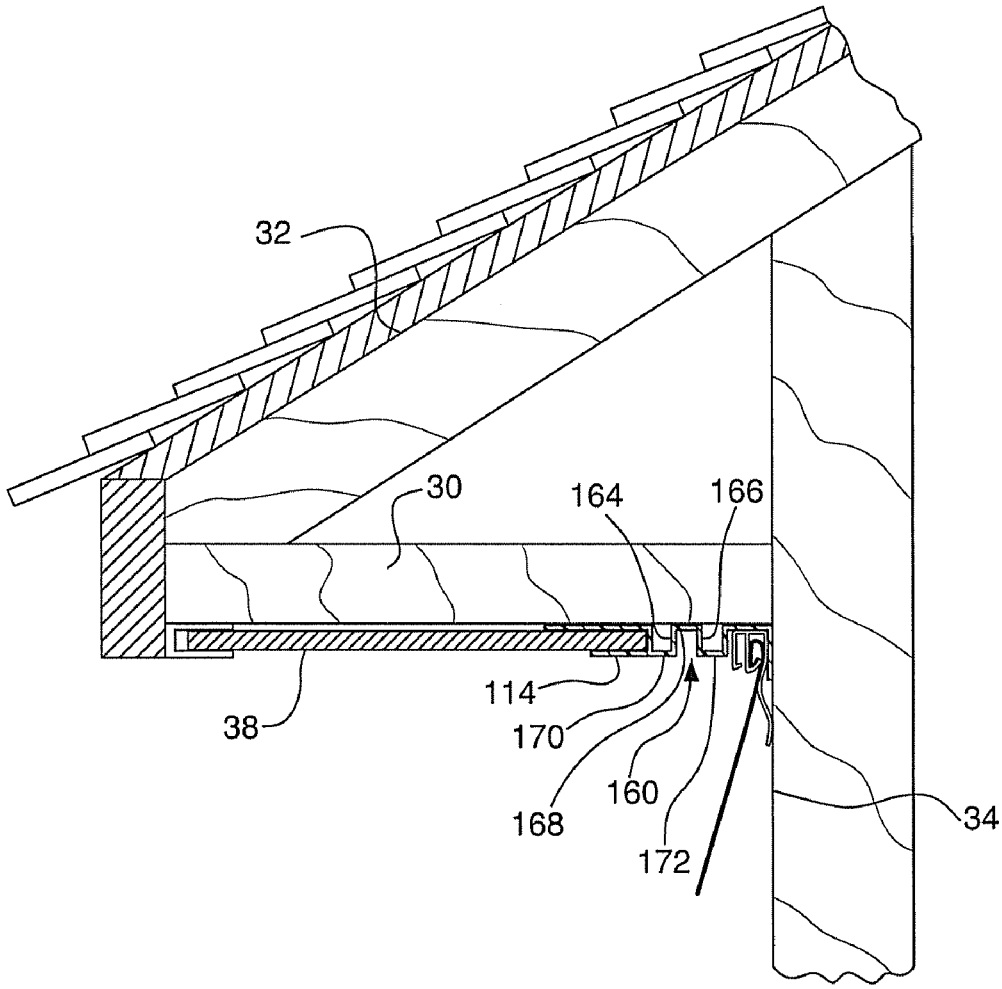
FIG. 4 is a side cross-sectional view of the trim accessory of FIG. 3 shown installed on the exterior of a building.

Referring now to FIGS. 3 and 4, another embodiment of a trim accessory 200 is shown comprising a soffit receiver component 110, a siding accessory receiver component 140 and a plurality of vent apertures 150, 162. As with trim accessory 100, the trim accessory 200 is a one-piece accessory which may be formed of various materials such as metal, plastic and composite materials by molding, drawing, extruding or roll-forming.

The soffit receiver component 110 includes an attachment edge portion 112, a bottom portion 114, and a connecting portion 116. The attachment edge portion 112, bottom portion 114 and connecting portion form a soffit receiving channel 118. Preferably the soffit receiver component 110 is substantially J-shaped and includes a plurality of attachment slots 120 on the attachment edge portion 112. The attachment edge portion 112 is secured to soffit furring board 30, for example, underneath the eave of a roof 32 by nails or screws inserted through attachment slots 120.

The siding accessory receiver component 140 includes a back edge portion 142, a front portion 144 and a connecting portion 146. The back edge portion 142, front portion 144 and connecting portion 146 form a siding accessory receiving channel 148. Preferably, the siding accessory receiver component 140 is substantially U-shaped or J-shaped. Upon installation, the back edge portion 142 of the siding accessory receiver component 140 is against the outside wall 34 of the building structure. Such back edge portion 142 may include attachment slots (not shown) for securing the back edge portion 142 against the outside wall 34. The siding accessory receiver component 140 may also include vent apertures 150 for facilitating air circulation and air movement. The vent apertures 150 are preferably located on the front portion 144 as shown in FIG. 3. At these locations, the vent apertures 150 will be substantially hidden from view upon installation of the trim accessory 200 and corresponding siding panels 36 and soffit panels 38 as shown in FIG. 4.

The trim accessory 200 may also include a vent component 160 which is employed to accommodate vent apertures 162. As shown in FIG. 3, the vent component 160 may include a first and second parallel edge 164, 166, and a connecting edge 168, forming a channel 180, and a first and second joining edge 170, 172. The vent apertures 162 are preferably located on one of both of parallel edges 164, 166, as shown, or any other location on the vent component 160 which facilitates air circulation behind the soffit panels and/or siding panels while remaining substantially hidden from the view of an observer.

In the exemplary embodiment of FIG. 3, joining edge 170 connects parallel edge 164 to the soffit receiver component 110 and joining edge 172 connects parallel edge 166 to the siding accessory receiver component 140. As with the vent component 60 of trim accessory 100, it should be understood that the vent component 160 can have any configuration that allows the vent apertures to be hidden, or substantially hidden, from view upon installation of the trim accessory 200 and the corresponding soffit and siding panels.

Figure 7:
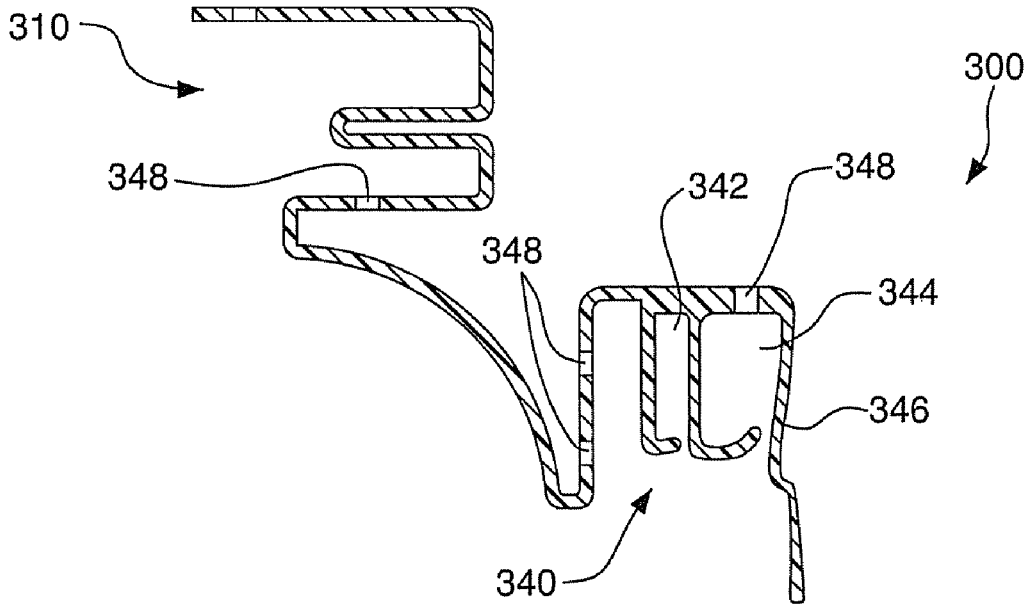
FIG. 7 is a side cross-sectional view of another exemplary embodiment of a trim accessory.
Figure 8:
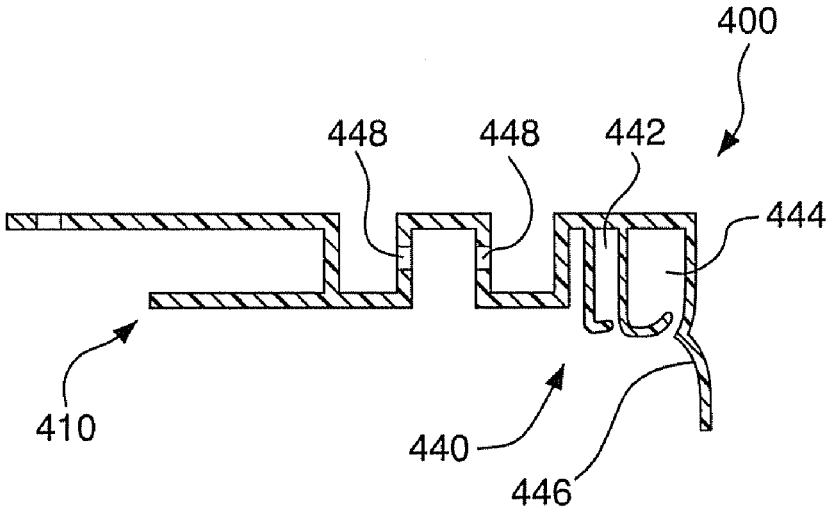
FIG. 8 is a side cross-sectional view of another exemplary embodiment of a trim accessory.

Referring now to FIGS. 7 and 8, further embodiments of trim accessories 300, 400 are shown comprising a soffit receiver component 310, 410, a siding panel receiver component 340, 440 and a plurality of vent apertures 348, 448. Trim accessory 300 is similar to trim accessory 100, with the exception that a siding accessory trim piece is integral (formed from a single piece of material) with the trim accessory forming the siding panel receiver component 340. Likewise, trim accessory 400 is similar to trim accessory 200, with the exception that a siding accessory trim piece is integral with the trim accessory forming the siding panel receiver component 440. The siding panel receiver component preferably includes two channels 342, 344, 442, 444 capable of receiving a siding panel and a back edge 346, 446 capable of attachment to the outside wall 34 of a building structure.

The dimensions, such as length, width and thickness, of the various elements of the trim accessories 100, 200 (including those of the vent apertures) may vary depending on aesthetics and the types of soffit and siding panels employed, as well as the requirements for adequate ventilation of the building panels.

A trim system may be employed, according to an additional aspect of the present invention, by providing a trim accessory having a soffit receiver component, a siding accessory receiver component integral with said soffit receiver component, and vent apertures, and installing the trim accessory on the exterior surface of the building such that the vent apertures are substantially hidden from the view of an observer located beneath the trim accessory. Referring to FIGS. 2 and 4, the trim accessories 100, 200 can be installed on a building structure by attaching the attachment edge portion 12, 112 of the soffit receiver component 10, 110 to the facia board 30 via fasteners, such as nails or screws. A soffit panel 38 may then be received into the soffit receiving channel 18, 118 of the soffit receiver component 10, 110, and a siding accessory 37 (such as a dual undersill siding accessory (as shown), for example) may be received into the siding accessory receiving channel 48, 148 of the siding accessory receiver component 40, 140. Upon installation of the siding accessory 37, a siding panel 36 may be installed into the siding accessory 37.

Figure 5:
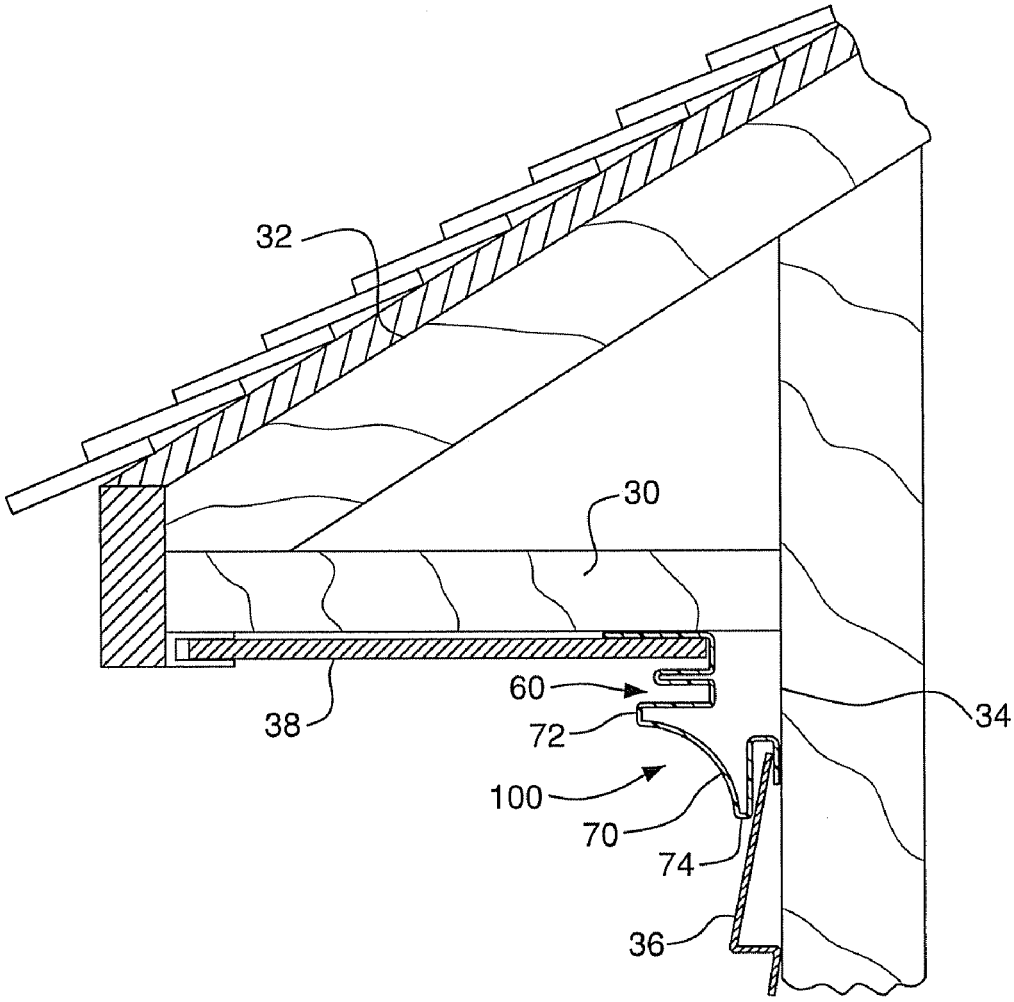
FIG. 5 is a side cross-sectional view of the trim accessory of FIG. 1 shown installed on the exterior of a building and directly receiving a siding panel.
Figure 6:
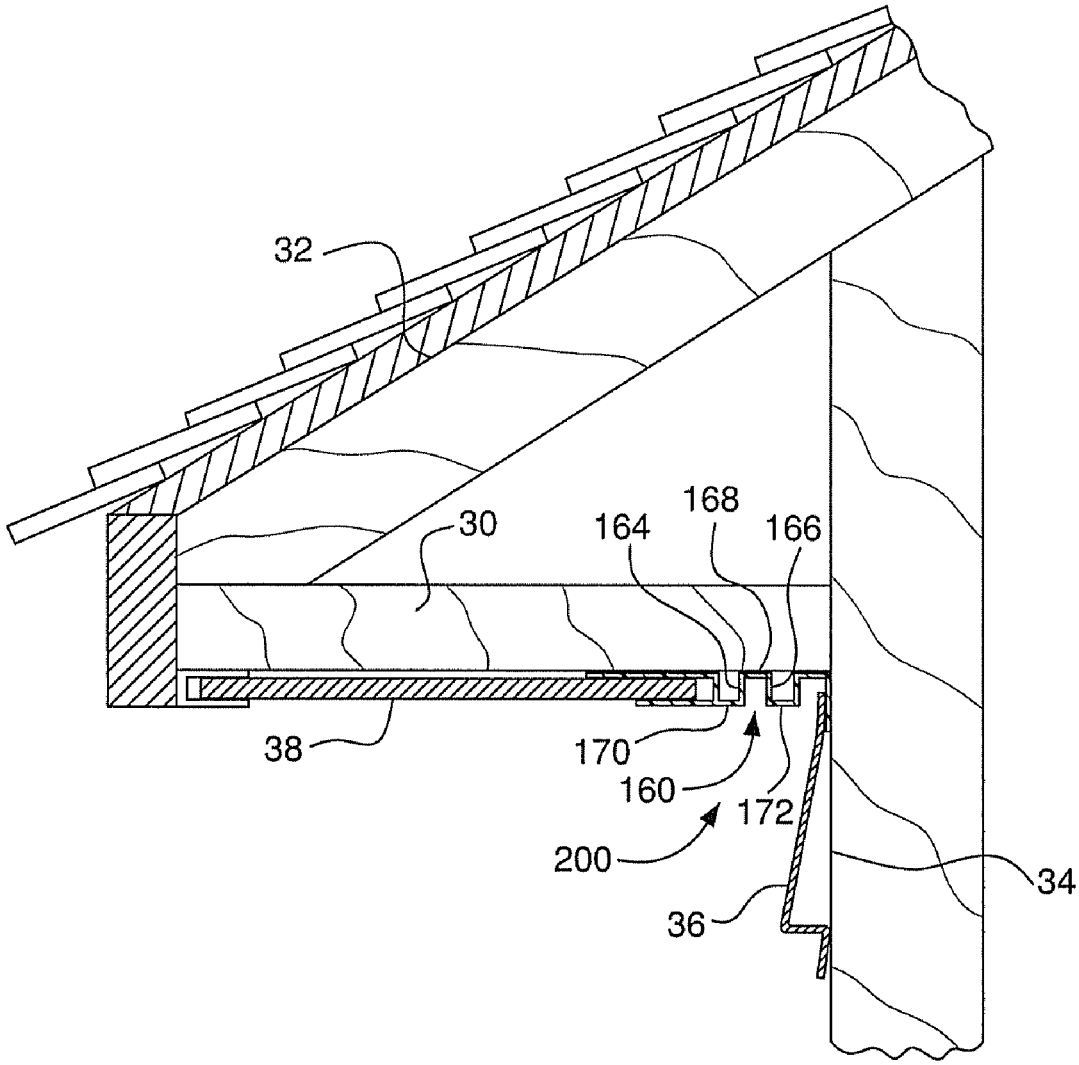
FIG. 6 is a side cross-sectional view of the trim accessory of FIG. 3 shown installed on the exterior of a building and directly receiving a siding panel.

In alternative embodiments, as shown in FIGS. 5 and 6, a siding panel 36 may be directly installed into the trim accessory 100, 200 without the need for a siding accessory piece.

While this invention has been disclosed with reference to specific embodiments, it is apparent that other embodiments and variations of this invention can be devised by others skilled in the art without departing from the true spirit and scope of the invention. The appended claims include all such embodiments and equivalent variations.

What is claimed is:

1. A trim accessory comprising:

a soffit receiver component having first and second side walls and a first connecting wall;

a siding accessory receiver component integral with said soffit receiver component and having first and second side walls and a connecting wall distinct from the side walls and connecting wall of the soffit receiver component, one of said side walls of the soffit receiver component or said side walls of the siding accessory receiver component having an attachment portion that is shaped and positioned to be attached to a building, the attachment portion having attachment apertures, and an additional channel portion of said trim accessory, connected between said soffit receiver component and said siding accessory receiver component, the additional channel portion having first and second side walls connected to each other by a connecting wall, the side walls and connecting wall of the additional channel portion distinct from said side walls and connecting wall of said soffit receiver component and distinct from said side walls and connecting wall of said siding accessory receiver component, so the soffit receiver component and said siding accessory receiver component are separated from each other by the additional channel portion, one of the side walls of the additional channel portion being connected to one of the side walls of the soffit receiver component, one of the side walls of the additional channel portion having a first plurality of vent apertures disposed therethrough, said vent apertures located in a separate plane from a plane in which the attachment apertures are located.

2. The trim accessory of claim 1, wherein the trim accessory is comprised of polyvinylchloride.

3. The trim accessory of claim 1, further comprising a crown molding or cove molding located intermediate said soffit receiver component and said siding accessory receiver component, the crown molding or cove molding being formed from the same piece of material as said soffit receiver component and said siding accessory receiver component.

4. The trim accessory of claim 1, wherein the first side wall of said soffit receiver component includes an attachment portion, the second side wall of said soffit receiver component includes a bottom portion the first side wall of said siding accessory receiver component includes a back portion, and the second side wall of said siding accessory receiver component includes a front portion.

5. The trim accessory of claim 4, wherein at least one of said bottom portion or said connecting wall of said soffit receiver component or said front portion or said connecting wall of said siding accessory receiver component includes an additional plurality of vent apertures.

6. The trim accessory of claim 5, wherein the additional plurality of vent apertures are located in two different planes separate from the respective planes in which the attachment apertures and first plurality of vent apertures are located.

7. The trim accessory of claim 1, further comprising a bend connecting said additional channel portion of said trim accessory to said soffit receiver component.

8. The trim accessory of claim 7, wherein an end of said additional channel portion of said trim accessory is directly connected to a first end of an ornamental component, and the siding accessory receiver component is directly connected to a second end of the ornamental component.

9. The trim accessory of claim 1, wherein a first end of said additional channel portion is directly connected to said soffit receiver component and wherein a second end of said additional channel portion is directly connected to said siding accessory receiver component.

10. A trim accessory comprising:

a soffit receiver component including a first wall having an attachment portion, a bottom wall, and a connecting wall, said first wall, bottom wall and connecting wall defining a soffit receiving channel, and a siding accessory receiver component integral with said soffit receiver component and having a back wall a front wall and a connecting wall, said back wall, front wall and connecting wall defining a siding accessory receiving channel, and a vent component connected between said soffit receiver component and said siding accessory receiver component, the vent component having three walls distinct from the walls of said soffit receiver component and distinct from the walls of said siding accessory receiver component, so the soffit receiver component and said siding accessory receiver component are separated from each other by the vent component, the vent component having a first plurality of vent apertures disposed therethrough, and wherein the connecting wall and front wall of the siding accessory receiver component include a second plurality of vent apertures.

11. The trim accessory of claim 10, wherein a first end of said vent component is directly connected to said soffit receiver Component and wherein a second end of said vent component is directly connected to said siding accessory receiver component.

12. The trim accessory of claim 10, further comprising an ornamental component located intermediate said soffit receiver component and siding accessory receiver component, separating the vent component from the siding accessory receiver component.

13. The trim accessory of claim 10, wherein the trim accessory is a one-piece plastic extruded article.

14. A trim accessory comprising:

a soffit receiver component having a first wall with an attachment portion, a bottom wall and a connecting wall, said first wall bottom wall and connecting wall defining a soffit receiving channel, a siding accessory receiver component integral with said soffit receiver component and having a back wall, a front wall and a connecting wall, said back wall, front wall and connecting wall defining a siding accessory receiving channel, a multiple-walled vent component connected to the soffit receiver component and located intermediate said soffit receiver component and said siding accessory receiver component, wherein said vent component includes vent apertures, said vent component contacting the soffit receiver component at a single connecting edge; and a multiple-walled ornamental component distinct from the vent component and located intermediate said soffit receiver component and siding accessory receiver component, wherein said ornamental component has only a first end directly connected to the vent component and only a second end directly connected to the siding accessory receiver component, the second end opposite the first end.

15. The trim accessory of claim 14, wherein the ornamental component is a crown molding or a cove molding

16. A trim accessory comprising:

a soffit receiver component having a first wall with an attachment portion, a bottom wall and a connecting wall, said first wall bottom wall and connecting wall defining a soffit receiving channel, and a vent component including first and second parallel walls and a connecting wall that connects the first and second parallel walls, the first parallel wall connected to the bottom wall of the soffit receiver component, the vent component having a first plurality of vent apertures through one of the first and second parallel walls;

a cove molding or a crown molding directly connected to one of the first and second parallel walls of the vent component having the first plurality of vent apertures, with the first plurality of vent apertures facing a back surface of the cove molding or the crown molding;

a siding accessory receiver component directly connected to the cove molding or the crown molding, the siding accessory receiver component having a back wall, a front wall and a connecting wall, said back wall, front wall and connecting wall defining a siding accessory receiving channel, wherein at least one of said bottom wall or said connecting wall of said soffit receiver component or said front wall or said connecting wall of said siding accessory receiver component includes a second plurality of vent apertures, wherein the trim accessory is a one-piece plastic post-formed extruded article.

17. A trim accessory, comprising:

a soffit receiving channel having three walls, and located at a first end of the trim accessory;

a siding accessory receiving channel having three walls distinct from the walls of the soffit receiving channel, the siding accessory receiving channel located at a second end of the trim accessory opposite the first end;

a crown molding or a cove molding directly connected to said siding accessory receiver channel;

a vent channel having three walls distinct from the walls of the soffit receiving channel and distinct from the walls of the siding accessory receiving channel, the vent channel having a first plurality of vent apertures through one of the walls thereof, the vent channel connected between the soffit receiving channel and the crown molding or the cove molding, the vent channel connected to one of the walls of the soffit receiving channel by a first bend and to the crown molding or the cove molding by a second bend;

wherein the soffit receiving channel, the siding accessory receiving channel, the crown mold or the cove molding, and the vent channel are formed from a single piece of material.

18. The trim accessory of claim 17, wherein the first plurality of vent apertures of the vent channel are located in one of the walls thereof that is directly connected to the crown molding or the cove molding.

19. The trim accessory of claim 17, wherein the siding accessory receiver channel includes a second plurality of vent apertures in one of the walls thereof that is directly connected to the crown molding or the cove molding.

* * * * *

UNITED STATES PATENT AND TRADEMARK OFFICE

CERTIFICATE OF CORRECTION

PATENT NO. : 7,487,623 B2
APPLICATION NO. : 10/758154
DATED : February 10, 2009
INVENTOR(S) : Saul Le-Garcia Rodolfo and Thomas Charles Gilbert It is certified that error appears in the above-identified patent and that said Letters Patent is hereby corrected as shown below:

Title Page, Section (75) Inventors, delete “Rodolofo” and insert therefor --Rodolfo--

Signed and Sealed this

Twenty-first Day of April, 2009

JOHN DOLL
*Acting Director of the United States Patent and Trademark Office*